US008617801B2

(12) United States Patent
Dickerson

(10) Patent No.: US 8,617,801 B2
(45) Date of Patent: Dec. 31, 2013

(54) FILM WITH BLUE DYE

(75) Inventor: Robert E. Dickerson, Hamlin, NY (US)

(73) Assignee: Carestream Health, Inc., Rochester, NY (US)

( * ) Notice: Subject to any disclaimer, the term of this patent is extended or adjusted under 35 U.S.C. 154(b) by 48 days.

(21) Appl. No.: 12/897,232

(22) Filed: Oct. 4, 2010

(65) Prior Publication Data

US 2011/0053098 A1 Mar. 3, 2011

Related U.S. Application Data

(63) Continuation-in-part of application No. 12/477,298, filed on Jun. 3, 2009, now abandoned.

(51) Int. Cl.

| | |
|---|---|
| ***G03C 1/06*** | (2006.01) |
| ***G03C 1/08*** | (2006.01) |
| ***G03C 1/815*** | (2006.01) |
| ***G03C 1/825*** | (2006.01) |
| ***G03C 1/76*** | (2006.01) |

(52) U.S. Cl.
USPC ..... 430/517; 430/502; 430/508; 430/559; 430/567; 430/523; 430/966

(58) Field of Classification Search
USPC ..... 430/502, 508, 517, 559, 567, 523, 966
See application file for complete search history.

(56) References Cited

U.S. PATENT DOCUMENTS

| | | | | |
|---|---|---|---|---|
| 1,973,886 | A | 9/1934 | Scanlan et al. | |
| 3,933,502 | A | 1/1976 | Arai et al. | |
| 3,948,664 | A | 4/1976 | Okuyama et al. | |
| 4,414,310 | A | 11/1983 | Daubendiek et al. | |
| 4,425,425 | A | 1/1984 | Abbott et al. | |
| 4,425,426 | A | 1/1984 | Abbott et al. | |
| 4,434,226 | A | 2/1984 | Wilgus et al. | |
| 4,435,501 | A | 3/1984 | Maskasky | |
| 4,439,520 | A | 3/1984 | Kofron et al. | |
| 4,713,320 | A | 12/1987 | Maskasky | |
| 4,803,150 | A | 2/1989 | Dickerson et al. | |
| 4,900,355 | A | 2/1990 | Tanno et al. | |
| 4,994,355 | A | 2/1991 | Dickerson et al. | |
| 4,997,750 | A | 3/1991 | Dickerson et al. | |
| 5,021,327 | A | 6/1991 | Bunch et al. | |
| 5,147,771 | A | 9/1992 | Tsaur et al. | |
| 5,147,772 | A | 9/1992 | Tsaur et al. | |
| 5,147,773 | A | 9/1992 | Tsaur et al. | |
| 5,171,659 | A | 12/1992 | Tsaur et al. | |
| 5,252,442 | A | 10/1993 | Dickerson et al. | |
| 5,370,977 | A | 12/1994 | Zietlow | |
| 5,391,469 | A | 2/1995 | Dickerson | |
| 5,399,470 | A | 3/1995 | Dickerson et al. | |
| 5,411,853 | A | 5/1995 | Maskasky | |
| 5,418,125 | A | 5/1995 | Maskasky | |
| 5,494,789 | A | 2/1996 | Daubendiek et al. | |
| 5,503,970 | A | 4/1996 | Olm et al. | |
| 5,518,872 | A | 5/1996 | King et al. | |
| 5,536,632 | A | 7/1996 | Wen et al. | |
| 5,567,580 | A | 10/1996 | Fenton et al. | |
| 5,573,902 | A | 11/1996 | Daubendiek et al. | |
| 5,576,156 | A | 11/1996 | Dickerson | |
| 5,576,168 | A | 11/1996 | Daubendiek et al. | |
| 5,576,171 | A | 11/1996 | Olm et al. | |
| 5,582,965 | A | 12/1996 | Deaton et al. | |
| 5,620,840 | A | 4/1997 | Maskasky | |
| 5,667,955 | A | 9/1997 | Maskasky | |
| 5,744,294 | A * | 4/1998 | Dickerson et al. | 430/521 |
| 5,851,243 | A | 12/1998 | Dickerson et al. | |
| 5,876,913 | A | 3/1999 | Dickerson et al. | |
| 6,027,866 | A | 2/2000 | Ohzeki | |
| 6,517,986 | B1 | 2/2003 | Dickerson | |
| 2003/0215761 | A1 | 11/2003 | Yamazaki et al. | |

FOREIGN PATENT DOCUMENTS

| | | |
|---|---|---|
| DE | 1937 486 | 7/1968 |
| EP | 0 169 039 | 7/1985 |
| EP | 0 481 651 | 4/1992 |
| EP | 0 733 941 | 2/1996 |
| EP | 0 866 364 | 3/1998 |
| EP | 1 041 436 | 3/2000 |
| EP | 2 259 136 | 12/2010 |
| GB | 1137595 | 12/1968 |
| GB | 1250983 | 9/1972 |
| JP | 60243654 | 5/1984 |
| JP | 06266031 | 3/1993 |
| JP | 05-165147 | 6/1993 |
| JP | 06-266031 | 9/1994 |
| JP | 2009-086332 | 4/2009 |

OTHER PUBLICATIONS

Communication Pursuant to Article 94(3) EPC dated Jan. 7, 2011, from the European Patent Office re: Application No. 10 013 862.7.

(Continued)

*Primary Examiner* — Geraldina Visconti

(57) ABSTRACT

A radiographic X-ray film comprising a polymer support. One or more silver halide emulsion layers are coated on each side of the support. A blue dye is contained within at least one of the polymer support or in an adjacent hydrophilic layer in a sufficient amount to result in a CIELAB measurement of L* less than or equal to 80 and b* less than or equal to −25. This configuration provides, after imaging and development, radiographic images having desirable visual contrast, image tone, b*, and image quality.

15 Claims, 3 Drawing Sheets

(56) References Cited

OTHER PUBLICATIONS

Sam M. Berman, Lawrence Berkeley National Laboratory, Berkeley, CA 94720, New Discoveries in Vision Affect Lighting Practice, p. 1-8.

Research Disclosure 38957, Photographic Silver Halide Emulsions, Preparation, Addenda, Systems and Processing, Annonymous.

Billmeyer et al., Text Book, Principles of Color Technology, 3rd Edition, ISBN-10: 047119459X, ISBN-13: 978-0471194590, 304 pages, Publisher: Wiley-Interscience, 2000.

Research Disclosure 18431, XII, Radiographic films/materials, JW Carpenter, ISSN: 0374-4353.

EP Search Report, Application No. 10003593.0/1217, Applicant: Carestream Health, Inc., dated Apr. 29, 2010.

Sam M. Berman, Lawrence Berkeley National Laboratory, Berkeley, CA 94720, "New Discoveries in Vision Affect Lighting Practice," 9 pages, printed from Internet on Jul. 10, 2012, from website www.patmullins.com/data/gilbermannewdiscoveries.pdf.

Research Disclosure 38957, Photographic Silver Halide Emulsions, Preparation, Addenda, Systems and Processing, Annonymous, Sep. 1996, 97 pages.

Research Disclosure 18431, XII, Radiographic films/materials, JW Carpenter, ISSN: 0374-4353, Aug. 1979, 18 pages.

* cited by examiner

FILM WITH BLUE DYE

RELATED APPLICATIONS

This application is a Continuation-in-Part and claims the benefit of priority to U.S. application Ser. No. 12/477,298, entitled "Film with Blue Dye", filed Jun. 3, 2009 now abandoned , which application is commonly assigned and incorporated herein by reference in its entirety.

FIELD OF THE INVENTION

The invention relates generally to film, imaging, and the field of radiography, particularly X-ray radiography. More specifically, the invention relates to blue tinted X-ray films.

BACKGROUND OF THE INVENTION

W. C. Roentgen discovered X-radiation by the exposure of a silver halide imaging element. In 1913, Eastman Kodak Company introduced its first product specifically intended to be exposed by X-radiation (X-rays). Today, radiographic silver halide films account for the majority of world-wide medical diagnostic images. Such films provide viewable black-and-white images upon imagewise exposure followed by processing with the suitable wet developing and fixing photochemicals.

In medical radiography an image of a patient's anatomy is produced by exposing the patient to X-rays and recording the pattern of penetrating X-radiation using a radiographic film containing at least one radiation-sensitive silver halide emulsion layer coated on a transparent support. An approach to reducing patient exposure is to employ one or more phosphor-containing intensifying screens in combination with the radiographic film (usually both in the front and back of the film). An intensifying screen absorbs X-rays and emits longer wavelength electromagnetic radiation that the silver halide emulsions more readily absorb.

Another technique for reducing patient exposure is to coat two silver halide emulsion layers on opposite sides of the film support to form a "dual coated" radiographic film so the film can provide suitable images with even less exposure. Of course, a number of commercial products provide assemblies of both single- and dual-coated films in combination with one or two intensifying screens to allow the lowest possible patient exposure to X-rays. Typical arrangements of film and screens are described in considerable detail for example in U.S. Pat. No. 4,803,150 (Dickerson et al.), U.S. Pat. No. 5,021,327 (Bunch et al.), and U.S. Pat. No. 5,576,156 (Dickerson).

Medical radiographic X-radiation films are currently manufactured with several different contrasts in order to meet the diverse radiographic imaging needs. These include high contrast films such as commercially available Carestream Health TMAT-G Film and low contrast films such as Carestream Health TMAT-L Film. High contrast films are designed to image anatomy parts that exhibit a narrow range of X-radiation absorbance (such as bones). Medium and low contrast films are designed to image simultaneously several different types of anatomy having different X-radiation absorbance. Radiography of the thoracic cavity (chest) is an example of this need where radiologists need to image the relatively radio-opaque mediastinal area (behind the vertebral column, heart, and diaphragm). These areas are quite dense and require greater amounts of X-radiation for desired penetration and imaging on a film. However, it is also desired to image the more radio-transparent lungs. Such imaging requires less X-radiation. Carestream Health InSight™ IT Film and Carestream Health InSight™ VHC Film, and the appropriate intensifying screens, are low crossover systems designed to record this wide range of tissue densities with high imaging quality and varying exposure latitude. In these low-crossover systems, the dual-coated silver halide layers are predominantly exposed by the X-ray intensifying screen closest to the layer.

X-ray radiographic films containing blue-tinted dyes have been utilized for several decades. A primary reason for such dyes is to improve the image tone of the resulting radiographic images. Radiographic images formed by exposure to X-rays on an X-ray radiographic film consist of silver deposits that have a yellow-brown appearance that is objectionable to many radiologists. The resulting color from the developed silver can be measured using spectral absorption techniques, and is measured as a higher absorbance in the blue portion of the visible spectrum. In order to compensate for this color, blue-tinting dyes are added to the film, thereby increasing the spectral absorbance in the green and red portions of the visible spectrum. The result is a radiograph with an acceptable blue-red appearance, i.e. improved image tone.

Addition of blue-tinting dye also has the effect of increasing film Dmin or total optical density of the unexposed or low-exposure region of a processed radiographic film. The Dmin value, as measured after film exposure and processing, is generally considered to contain at least the following two factors: (1) an optical density due to the support and tinting dyes that are present before and after processing, and (2) an optical density resulting from the processing itself. For the purpose of discussing this invention, factor (2) is referred to as conventional silver fog. The Dmin value of a radiograph is considered a primary criterion for acceptable performance of a radiographic film in customer usage, as established by various standards committees that monitor performance of X-ray films in the field of medical radiography. These standard committees can be local, statewide, national, or even international organizations that set limits on various film parameters that measure the performance of X-ray films. It is generally accepted that lower Dmin value yields an improved radiograph, with higher image quality for reading details and features. Several standards committees have set acceptable limits on film Dmin to be as low as 0.25 or 0.30 for the whole lifetime of a film. These low Dmin specifications often result in reduced expiration dating of a film because the Dmin from silver fog increases with age.

U.S. Pat. No. 1,973,886 (Scanlan) describes an X-ray film including the addition of a blue tint to an X-ray base material.

U.S. Pat. No. 5,851,243 (Dickerson) patent describes the addition of a blue dye to increase neutral density in minimum density areas of an X-ray film.

U.S. Pat. No. 6,517,986 (Dickerson) describes the a* and b* values of a X-ray film containing colorants.

The publication "New Discoveries in Vision Effect Lighting Practice" by Sam M. Berman of Lawrence Berkeley National Laboratory in Berkeley, Calif. 94720 describes discoveries concerning photosensitivity of the eye.

There remains a need for improved X-ray films. In particular, there is a need for improved films for use with mammography and general-purpose radiography. Such films would have improved visual contrast, improved image quality, and/or provide the capability of improved radiographic or radiologic diagnosis.

SUMMARY OF THE INVENTION

The invention provides a radiographic X-ray film comprising a polymer support; and having disposed on both sides of the polymer support one or more silver halide emulsion layers. The silver halide emulsions may have different compositions but at least 50% of the total silver halide grain projected surface area comprises a tabular silver halide. A blue dye is contained within the polymer support, or within one or more additional hydrophilic layers or in both the polymer support and in the one or more additional hydrophilic layers. The blue dye is present in a sufficient amount to result in a CIELAB measurement of L* less than or equal to 80 and a b* value less than or equal to −25.

The invention also provides improved X-ray films.

The invention also provides an X-ray film with improved visual contrast.

The invention further provides an X-ray film with improved image quality.

The invention yet further provides an X-ray film with the capability of improved radiographic or radiologic diagnosis.

These embodiments are given only by way of illustrative example, and such objects may be exemplary of one or more embodiments of the invention. Other desirable objectives and advantages inherently achieved by the disclosed invention may occur or become apparent to those skilled in the art. The invention is defined by the appended claims.

BRIEF DESCRIPTION OF THE DRAWINGS

The foregoing and other objects, features, and advantages of the invention will be apparent from the following more particular description of the embodiments of the invention, as illustrated in the accompanying drawings.

The elements of the drawings are not necessarily to scale relative to each other.

DETAILED DESCRIPTION OF THE INVENTION

Figure 1:
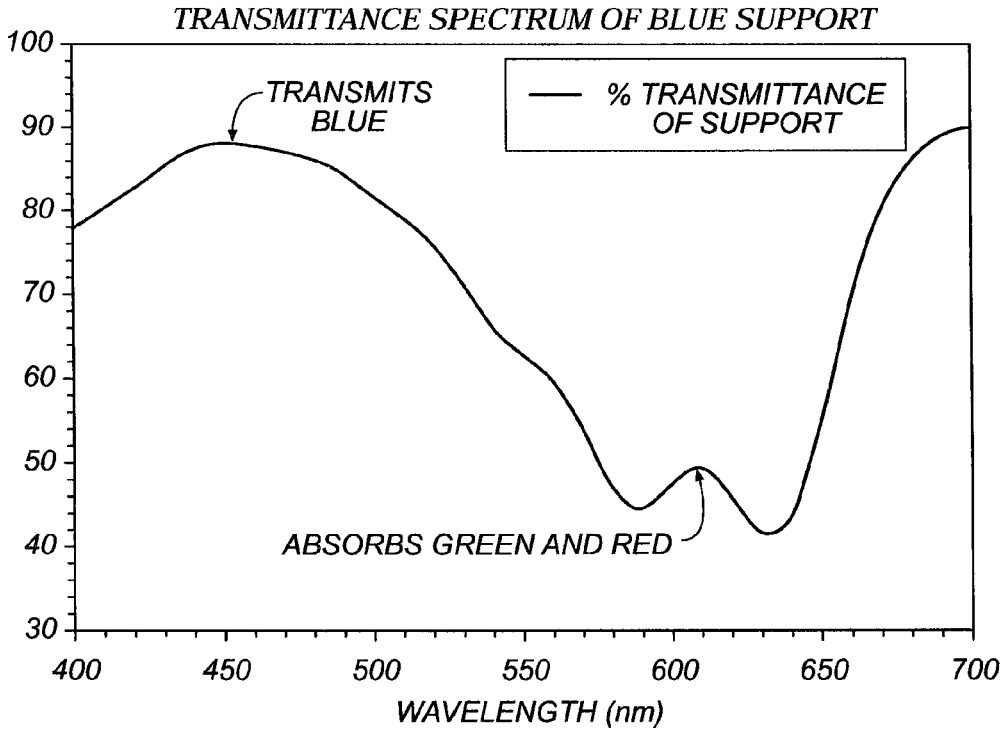
FIG. 1 shows transmittance of an imaging support.

The following is a detailed description of the preferred embodiments of the invention.

The CIELAB b* values describe the yellowness vs. blueness of an image with more positive values indicating a tendency toward greater yellowness, CIELAB a* values compare greenness vs. redness, where more positive values indicating a higher proportion toward redness. CIELAB L* or luminosity is a measure of how much light is transmitted from an object to the eye. L*, a* and b* measurement techniques are described by Billmeyer and Saltzman, Principles of Color Technology, $2^{nd}$ Edition, Wiley, New York, 1981, at Chapter 3. The measurements of a* and b* were developed by the Commission Internationale de L'Esclairage (International Commission on Illumination).

The term "image quality" refers to a subjective factor that rates the capability of obtaining radiographically significant information in fully-processed film. For example, higher image quality can indicate better diagnostic imaging capability.

The term "contrast" as herein employed indicates the average contrast derived from a characteristic curve of a radiographic film using as a first reference point (1) a density ($D_1$) of 0.25 above minimum density and as a second reference point (2) a density ($D_2$) of 2.0 above minimum density, where contrast is $\Delta D$ (i.e. 1.75)÷$\Delta \log_{10}E$ ($\log_{10}E_2-\log_{10}E_1$), and where $E_1$ and $E_2$ are the exposure levels at the reference points (1) and (2).

The term "visual contrast" is a subjective factor that is a dependent on both image quality as defined above and contrast in the film's characteristic curve per the following definition: For example, a higher visual contrast of a fully-processed X-ray film (a radiograph) as it is viewed under diagnostic lighting conditions routinely used by those skilled in the art of obtaining information from the radiograph, can mean the detailed features in the film are more readily detected.

The term "fully forehardened" refers to the forehardening of hydrophilic colloid layers to a level that limits the weight gain of a radiographic film to less than 120% of its original (dry) weight in the course of wet processing. The weight gain is almost entirely attributable to the ingestion of water during such processing.

The term "rapid access processing" refers to employed to indicate dry-to-dry processing of a radiographic film in 45 seconds or less. That is, 45 seconds or less elapse from the time a dry imagewise exposed radiographic film enters a wet processor until it emerges as a dry fully processed film. In referring to grains and silver halide emulsions containing two or more halides, the halides are named in order of ascending molar concentrations.

The term "total grain projected area" refers to the area of the basal surface unit of the emulsion grain, summed over all grains in the film. For tabular and cubic emulsion grains described herein, the basal surface is (111) and (100), respectively.

The term "equivalent circular diameter" (ECD) defines the diameter of a circle having the same projected area as a silver halide grain.

The term "aspect ratio" of an emulsion grain refers to the ratio of the largest to smallest linear dimension. For example, aspect ratio for a tabular grain is the ratio of ECD to thickness.

The term "coefficient of variation" (COV) is defined as 100 times the standard deviation of grain ECD divided by the mean grain ECD. Lower COV means higher degree of monodispersity in the emulsion grain size distribution.

The term "covering power" indicates 100 times the ratio of maximum density to developed silver measured in $mg/dm^2$.

The term "dual-coated" refers to a radiographic film having silver halide emulsion layers disposed on both the front- and backsides of the support. The radiographic silver halide films used in the present invention are "dual-coated."

The term "photographic speed" for the radiographic films refers to the exposure necessary to obtain a density of at least 1.0 plus Dmin.

The terms "warmer" and "colder" in referring to image tone are used to mean CIELAB b* values measured at minimum density, or at density=1.2, that are more positive or negative, respectively. The b* values describe the yellowness vs. blueness of an image with more positive values indicating a tendency toward greater yellowness, a* values compare greenness vs. redness, where more positive values indicating a higher proportion toward redness. L* or luminosity is a measure of how much light is transmitted from an object to the eye. L*, a* and b* measurement techniques are described by Billmeyer and Saltzman, Principles of Color Technology, $2^{nd}$. Ed., Wiley, New York, 1981, at Chapter 3. The measurements of a* and b* were developed by the Commission Internationale de L'Esclairage (International Commission on Illumination).

The term "PAI" refers to the "primary active ingredient" in a material.

While the invention is being described with regard to radiography, those skilled in the art will recognize that the invention can be applied to other imaging applications, for example, business imaging.

The invention allows a formation of an improved X-ray film. The inventive X-ray film has better visual contrast, particularly for use in mammography as well as other areas. The inventive X-ray film has improved image quality. The inventive X-ray film has the capability for improved radiographic or radiologic diagnosis. The film utilizes materials similar to those materials already in the X-ray film but in different quantities to achieve an improved result at low cost. The improved X-ray film further can be used in current devices or equipment for taking X-ray exposures, X-processing the exposed X-ray film, and viewing the processed image on the X-ray film.

Where two or more silver halide emulsions are disposed on each side of the film support, the "bottom" silver halide emulsion layer is closest to the film support and is defined herein as the "first" or "third" emulsion depending upon which side of the support it resides. The "top" silver halide emulsion layer is farther from the film support and is defined herein as the second or fourth emulsion depending upon which side of the support it resides. Thus, the "first" and "second" silver halide emulsion layers are on one side of the support and the "third" and "fourth" silver halide emulsion layers are on the opposite side of the support.

The radiographic films of this invention include a flexible support having disposed on both sides thereof, one or more silver halide emulsion layers and optionally one or more non-radiation sensitive hydrophilic layer(s). The silver halide emulsions in the various layers can be the same or different, and can comprise mixtures of various silver halide particles of any crystalline morphology in one or more of the layers. These silver halide particles are more commonly known as emulsion grains.

In one embodiment, the invention provides a radiographic X-ray film comprising a polymer support; and having disposed on both sides of the polymer support one or more silver halide emulsion layers. The silver halide emulsions may have different compositions but at least 50% of the total silver halide grain projected surface area comprises a tabular silver halide. A blue dye is contained within the polymer support, or within one or more additional hydrophilic layers or in both the polymer support and in the one or more additional hydrophilic layers. The blue dye is present in a sufficient amount to result in a CIELAB measurement of L* less than or equal to 80 and a b* value less than or equal to −25.

In one embodiment, the radiographic X-ray film has the same single silver halide emulsion layer coated on both sides of the support, with the silver halide emulsion grains therein containing a distribution of different crystalline morphologies such that at least 50% of the total projected surface area of silver halide grains in both layers combined is provided by tabular grains having an aspect ratio greater than or equal to 5. It is also preferred that the films have a protective overcoat (described below) over the silver halide emulsion on each side of the support.

In another embodiment, the radiographic X-ray film has single silver halide emulsion layers on each side of the support that are different but each with a distribution of grain crystalline morphologies such that at least 50% of the total projected surface area of all silver halide grains in the X-ray film is provided by tabular grains having an aspect ratio greater than or equal to 5.

In a further embodiment, the radiographic X-ray film has different silver halide emulsion layers each comprising tabular grains, non-tabular grains, or mixtures thereof coated on each side of the support, and wherein at least 50% of the total projected surface area of all silver halide grains in the X-ray film is provided the tabular silver halide grains having an aspect ratio of greater than or equal to 5.

The support can take the form of any conventional imaging or radiographic element support that is transmissive to both X-radiation and light. Useful transparent supports for the films of this invention can be chosen from among those described in Research Disclosure, September 1996, Item 38957 XV: Supports, and Research Disclosure, Vol. 184, August 1979, Item 18431, XII: Film Supports. Research Disclosure is published by Kenneth Mason Publications, Ltd., The Book Barn, Westbourne, Hampshire, UK PO10 8RS.

In its simplest form the transparent film support consists of a transparent film chosen to allow direct adhesion of the hydrophilic silver halide emulsion layers or other hydrophilic layers. More commonly, the transparent film is itself hydrophobic and subbing layers are coated on the film to facilitate adhesion of the hydrophilic silver halide emulsion layers. Typically the film support is either colorless or blue tinted (the blue-tinting dye being present in one or both of the support film and the subbing layers). Referring to Research Disclosure, Item 38957, Section XV: Supports, cited above, attention is directed particularly to paragraph (2) that describes subbing layers, and paragraph (7) that describes preferred polyester film supports.

In a particular embodiment of this invention, the film contains enough blue dye contained either in the support or in one or more layers coated on the support or in both the support and coated layers such that a CIELAB measurement of the support and all blue dyes has an L* less than or equal to 80 and a b* less than or equal to −25.

In a further embodiment, at least one non-light sensitive hydrophilic layer is included with the one or more silver halide emulsion layers on each side of the film support. This layer may be called an interlayer or overcoat, or both.

The silver halide emulsion layers comprise one or more types of silver halide grains responsive to X-radiation. Such silver halide grains include those comprised of a halide composition having any combination of bromide, iodide, and chloride, subject to the sum total moles of halide equal to the moles of silver. Silver halide grain compositions particularly contemplated include those having at least 80 mol % bromide (preferably at least 98 mol % bromide) based on total moles of silver in a given emulsion layer. Such emulsions include silver halide grains composed of, for example, silver bromide, silver iodobromide, silver chlorobromide, silver iodochlorobromide, and silver chloroiodobromide. Iodide is generally limited to no more than 3 mol % (based on total moles of silver in the emulsion layer) to facilitate more rapid processing. Preferably iodide is from 0 to 2 mol % (based on total moles of silver in the emulsion layer) or eliminated entirely from the grains. The silver halide grains in each silver halide emulsion layer may be the same or different, or may be mixtures of grains with different crystal morphologies and/or different silver halide compositions and different chemical and spectral sensitizations.

The silver halide grains useful in this invention can have any desirable morphology including, but not limited to tabular, cubic, octahedral, cubo-octahedral, tetradecahedral, rhombic, orthorhombic, rounded, spherical, or other non-tabular morphologies, or be comprised of a mixture of two or more of such morphologies. The basal faces of the tabular grains may have any combination of morphologies, such as hexagonal, triangular, rounded, and truncated hexagonal. The films may be prepared from emulsions for which at least 50% of the total grain projected area within all silver halide emulsion layers combined is provided by tabular grains. Preferably, most (at least 50%) of the grains coated in the film are tabular grains, but any morphology is allowed subject to the condition of at least 50% of the total projected surface area from tabular grains. In one embodiment at least one of the silver halide layers further comprises one or more additional other silver halide grain morphologies, one of which is monodisperse cubic silver halide grains.

Thus, different silver halide emulsion layers can have silver halide grains of the same or different morphologies as long as at least 50% of the total projected surface area of all grains in the film is from tabular grains. Some imaging layers use cubic emulsions, where the grains have a cubic morphology with a diameter generally at least 0.5 μm and less than 2 μm (preferably from about 0.6 to about 1.4 μm). The useful diameter values for other non-tabular morphologies would be readily apparent to a skilled artisan in view of the useful diameter values provided for cubic and tabular grains.

Generally, the average equivalent circular diameter (ECD) of tabular grains used in the films is greater than 0.3 μm and less than 5 μm, and preferably greater than 0.5 and less than 4 μm. Most preferred ECD values are from about 1.0 to about 3.0 μm. The average thickness of the tabular grains used in this invention is generally at least 0.03 and no more than 0.2 μm, and preferably at least 0.04 and no more than 0.15 μm.

It may also be desirable to employ silver halide grains that exhibit a coefficient of variation (COV) of grain diameters of less than 30% and, preferably, less than 20%. In some embodiments, such as in mammography, it may be desirable to employ a grain population that is as highly monodispersed as can be conveniently realized. A highly monodispersed grain population has a very low COV, preferably below 10%. Methods for producing emulsions with monodispersed cubic grain populations are well know to those skilled in the art.

Generally, at least 50% (and preferably at least 80%) of the silver halide grain projected area from all emulsion layers is provided by tabular grains having an average aspect ratio greater than or equal to 5, and more preferably greater than 8.

Tabular grain emulsions that have the desired composition and sizes are described in greater detail in the following patents, the disclosures of which are incorporated herein by reference: U.S. Pat. No. 4,414,310 (Dickerson), U.S. Pat. No. 4,425,425 (Abbott et al.), U.S. Pat. No. 4,425,426 (Abbott et al.), U.S. Pat. No. 4,439,520 (Kofron et al.), U.S. Pat. No. 4,434,226 (Wilgus et al.), U.S. Pat. No. 4,435,501 (Maskasky), U.S. Pat. No. 4,713,320 (Maskasky), U.S. Pat. No. 4,803,150 (Dickerson et al.), U.S. Pat. No. 4,900,355 (Dickerson et al.), U.S. Pat. No. 4,994,355 (Dickerson et al.), U.S. Pat. No. 4,997,750 (Dickerson et al.), U.S. Pat. No. 5,021,327 (Bunch et al.), U.S. Pat. No. 5,147,771 (Tsaur et al.), U.S. Pat. No. 5,147,772 (Tsaur et al.), U.S. Pat. No. 5,147,773 (Tsaur et al), U.S. Pat. No. 5,171,659 (Tsaur et al.), U.S. Pat. No. 5,252,442 (Dickerson et al.), U.S. Pat. No. 5,370,977 (Zietlow), U.S. Pat. No. 5,391,469 (Dickerson), U.S. Pat. No. 5,399,470 (Dickerson et al.), U.S. Pat. No. 5,411,853 (Maskasky), U.S. Pat. No. 5,418,125 (Maskasky), U.S. Pat. No. 5,494,789 (Daubendiek et al.), U.S. Pat. No. 5,503,970 (Olm et al.), U.S. Pat. No. 5,536,632 (Wen et al.), U.S. Pat. No. 5,518,872 (King et al.), U.S. Pat. No. 5,567,580 (Fenton et al.), U.S. Pat. No. 5,573,902 (Daubendiek et al.), U.S. Pat. No. 5,576,156 (Dickerson), U.S. Pat. No. 5,576,168 (Daubendiek et al.), U.S. Pat. No. 5,576,171 (Olm et al.), and U.S. Pat. No. 5,582,965 (Deaton et al.).

The patents of Abbott et al., Fenton et al., Dickerson, and Dickerson et al. are also cited and incorporated herein by reference to show conventional radiographic film features in addition to gelatino-vehicle, high bromide (greater than or equal to 80 mol % bromide based on total silver) tabular grain emulsions and other features useful in the present invention.

A variety of silver halide dopants can be used, individually and in combination, to improve contrast as well as other common properties, such as speed and reciprocity characteristics. A summary of conventional dopants to improve speed, reciprocity and other imaging characteristics is provided by Research Disclosure, Item 38957, cited above, and Section 1. Emulsion grains and their preparation, sub-section D. Grain modifying conditions and adjustments, paragraphs (3), (4), and (5).

A general summary of silver halide emulsions and their preparation is provided by Research Disclosure, Item 38957, cited above, Section 1: Emulsion grains and their preparation. After precipitation and before chemical sensitization the emulsions can be washed by any convenient conventional technique, such as those disclosed by Research Disclosure, Item 38957, cited above, Section III: Emulsion washing.

The emulsions can be chemically sensitized by any convenient conventional technique as illustrated by Research Disclosure, Item 38957, Section IV: Chemical Sensitization. Sulfur, selenium or gold sensitization (or any combination thereof) are specifically contemplated. Sulfur sensitization is preferred, and can be carried out using for example, thiosulfates, thiosulfonates, thiocyanates, isothiocyanates, thioethers, thioureas, cysteine, or rhodanine. A combination of gold and sulfur sensitization is most preferred.

Instability that increases minimum density in negative-type emulsion coatings (that is, emulsion fog, also known as silver fog) can be protected against by incorporation of stabilizers, antifoggants, antikinking agents, latent-image stabilizers and similar addenda in the emulsion and contiguous layers prior to coating. Such addenda are illustrated by Research Disclosure, Item 38957, Section VII: Antifoggants and stabilizers, and Item 18431, Section II: Emulsion Stabilizers, Antifoggants and Antikinking Agents.

The silver halide emulsion layers and other hydrophilic layers on both sides of the support of the radiographic film generally contain conventional polymer vehicles (peptizers and binders) that include both synthetically prepared and naturally occurring colloids or polymers. The most preferred polymer vehicles include gelatin or gelatin derivatives alone or in combination with other vehicles. Conventional gelatino-vehicles and related layer features are disclosed in Research Disclosure, Item 38957, Section II. Vehicles, vehicle extenders, vehicle-like addenda and vehicle related addenda. The emulsions themselves can contain peptizers of the type set out in Section II, paragraph A. Gelatin and hydrophilic colloid peptizers. The hydrophilic colloid peptizers are also useful as binders and hence are commonly present in much higher concentrations than required to perform the peptizing function alone. The preferred gelatin vehicles include alkali-treated gelatin, acid-treated gelatin, or gelatin derivatives (such as acetylated gelatin, deionized gelatin, oxidized gelatin, and phthalated gelatin). Cationic starch used as a peptizer for tabular grains is described in U.S. Pat. No. 5,620,840 (Maskasky) and U.S. Pat. No. 5,667,955 (Maskasky). Both hydrophobic and hydrophilic synthetic polymeric vehicles can be used also. Such materials include, but are not limited to, polyacrylates (including polymethacrylates), polystyrenes, and polyacrylamides (including polymethacrylamides). Dextrans can also be used. Examples of such materials are described for example in U.S. Pat. No. 5,876,913 (Dickerson et al.), incorporated herein by reference.

The silver halide emulsion layers (and other hydrophilic layers) in the radiographic films of this invention are generally fully hardened using one or more conventional hardeners. Thus, the amount of hardener on each side of the support is generally at least 0.3% and up to 3% (preferably up to 1%), based on the total dry weight of the polymer vehicles on that side of the support.

Conventional hardeners can be used for this purpose, including but not limited to formaldehyde and free dialdehydes such as succinaldehyde and glutaraldehyde, blocked dialdehydes, α-diketones, active esters, sulfonate esters, active halogen compounds, s-triazines and diazines, epoxides, aziridines, active olefins having two or more active bonds, blocked active olefins, carbodiimides, isoxazolium salts unsubstituted in the 3-position, esters of 2-alkoxy-N-carboxydihydroquinoline, N-carbamoyl pyridinium salts, carbamoyl oxypyridinium salts, bis(amidino) ether salts, particularly bis(amidino) ether salts, surface-applied carboxyl-activating hardeners in combination with complex-forming salts, carbamoylonium, carbamoyl pyridinium and carbamoyl oxypyridinium salts in combination with certain aldehyde scavengers, dication ethers, hydroxylamine esters of imidic acid salts and chloroformamidinium salts, hardeners of mixed function such as halogen-substituted aldehyde acids (e.g., mucochloric and mucobromic acids), onium-substituted acroleins, vinyl sulfones containing other hardening functional groups, polymeric hardeners such as dialdehyde starches, and copoly(acrolein-methacrylic acid).

In one embodiment of the invention, each side of the radiographic film support contains silver at level that is generally at least 4 and no more than 30 mg/dm$^2$, and preferably at least 6 and no more than 20 mg/dm$^2$. In addition, the total coverage of polymer vehicle in each silver halide emulsion layer is generally at least 4 and no more than 50 mg/dm$^2$ and preferably no more than 20 mg/dm$^2$.

In other embodiments of the invention, such as mammography, dental, and non-destructive-testing, silver and gel levels may be higher.

Other polymer vehicle amounts are incorporated in the various non-silver layers on each side of the support. The amounts of silver and polymer vehicle on the two sides of the support can be the same or different. These amounts refer to dry weights.

The radiographic films generally include a surface protective overcoat on each side of the support that is typically provided for physical protection of the one or more silver halide emulsion layers. Each protective overcoat can be subdivided into two or more individual layers. For example, protective overcoats can be sub-divided into surface overcoats and interlayers (between the overcoat and silver halide emulsion layers). In addition to vehicle features discussed above the protective overcoats can contain various addenda to modify the physical properties of the overcoats. Such addenda are illustrated by Research Disclosure, Item 38957, Section IX: Coating physical property modifying addenda, A. Coating aids, B. Plasticizers and lubricants, C. Antistats, and D. Matting agents. Interlayers that are typically thin hydrophilic colloid layers can be used to provide a separation between the emulsion layers and the surface overcoats. It is quite common to locate some emulsion compatible types of protective overcoat addenda, such as anti-matte particles, in the interlayers. The overcoat on at least one side of the support can also include a blue toning dye or a tetraazaindene (such as 4-hydroxy-6-methyl-1,3,3a,7-tetraazaindene) if desired.

The protective overcoat is generally comprised of a hydrophilic colloid vehicle, chosen from among the same types disclosed above in connection with the emulsion layers. In conventional radiographic films protective overcoats are provided to perform two basic functions. They provide a layer between the emulsion layers and the surface of the element for physical protection of the emulsion layer during handling and processing. Secondly, they provide a convenient location for the placement of addenda, particularly those that are intended to modify the physical properties of the radiographic film. The protective overcoats of the films of this invention can perform both these basic functions.

In one embodiment, this invention features a light-sensitive radiographic film coated on a polyethylene terephthalate (PET) support containing a blue-tinting anthraquinone dye at a level sufficient to achieve the desired L* and b* values. In addition as an alternative to dye addition to the support, a blue-tinting dye can be added to any other adjacent layers as well. The films employed with these levels of blue-tinting dyes can be used for any black-and-white photographic film application, including but not limited to medical radiography, such as mammography, dental or general-purpose radiography, and non-destructive testing e.g. industrial X-ray.

Any suitable blue dye may be utilized in the invention. Typically such dyes are anthraquinone dyes. Exemplary anthraquinone dyes are shown below where each of G1, G2, and G3 is independently hydrogen or any alkyl group.

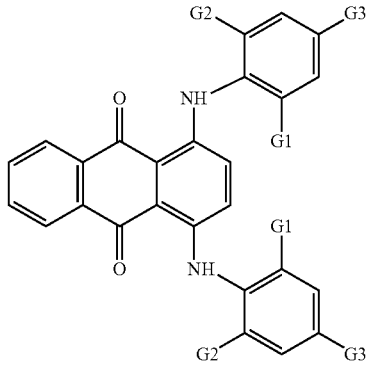

Four representative blue dyes are shown below:

| Blue Dye | G1 | G2 | G3 |
|---|---|---|---|
| Blue Dye 1 | Me | Et | H |
| Blue Dye 2 | Et | Et | H |
| Blue Dye 3 | Et | Et | Me |
| Blue Dye 4 | Me | Me | Me |

In one embodiment, a radiographic film is coated on a polyethylene terephthalate support containing one or more anthraquinone blue dyes represented by the general formula above. These dyes can be added to the support, or one or more emulsion layers, interlayers, and/or any other a hydrophilic layers. The dyes are added to the film at a level sufficient to enhance the scotopic response of the human eye. Films employed with these levels of blue-tinting dyes can be used for any black-and-white photographic film application, including but not limited to medical radiography, such as mammography, dental or general-purpose radiography, and non-destructive testing e.g. industrial X-ray.

As noted above, radiographic films have been coated on blue-tinted film supports for many decades. During that time however there was little understanding as to why blue-tinting dyes were used other than by empirical observations and radiologist preference. Recent understanding in the field of lighting (see reference above by Dr. S. Berman) provides greater insight to the effect of blue-tinting dyes in medical radiography. In this work, Dr. Berman states that enhancing the scotopic content of the illuminant hitting the retina of the eye leads to improvements in visualization of achromatic (black and white) tasks.

Figure 2:
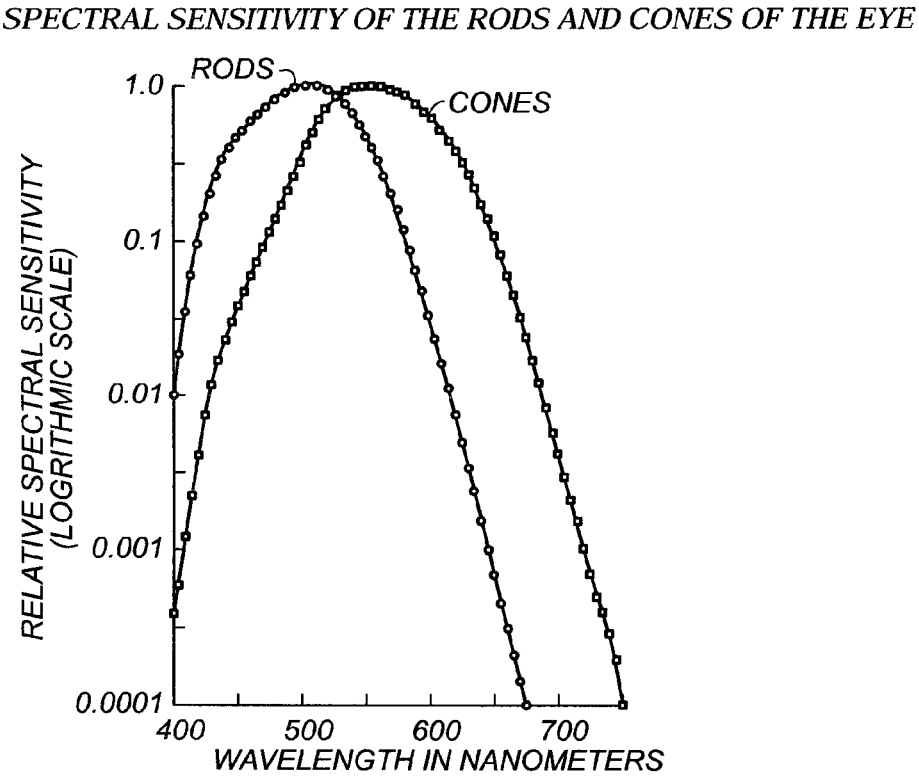
FIG. 2 shows sensitivity of the eye.

FIG. 1 shows a transmittance spectrum of a blue-tinted X-ray support and it shows that the blue dye used absorbs light in the green-red region of the visible spectrum and transmits blue light. FIG. 2 shows the color sensitivity of the rods (scotopic vision) of the eye has its peak sensitivity to blue light. We have discovered that by increasing the amount of blue dye in the radiographic film, improvements in visual response of the eye results by enhancing the scotopic content of the light reaching the eye in the viewing of an X-ray film radiograph. Surprisingly, we have found that improvements in image quality (diagnosis capability of the X-ray image) result at dye levels significantly higher than has been taught in the field of X-ray radiography. In addition, these higher levels of dyes can result in film Dmin values greater than the current acceptance criteria in the standards set by various regulatory agencies. Counter to the teachings in the literature and as established by radiographic standards, we have surprisingly found that image quality is actually increased at these higher dye levels and subsequent film Dmin values.

As stated above, an X-ray film with substantially more blue dye, leading to marked increases in image Dmin well above current standards, provides remarkably enhanced diagnostic capability of the X-ray image. Such Dmin values as achieved by introduction of silver fog, are markedly poorer in image quality.

The X-ray film of the inventive application can be employed in mammographic films. Dense breasts are more X-ray absorbent and present at lower film densities where blue support is more predominant. Increased visualization due from pyschovisual contrast will image dense breast parenchyma better. The overall visual contrast is also increased.

Figure 3:
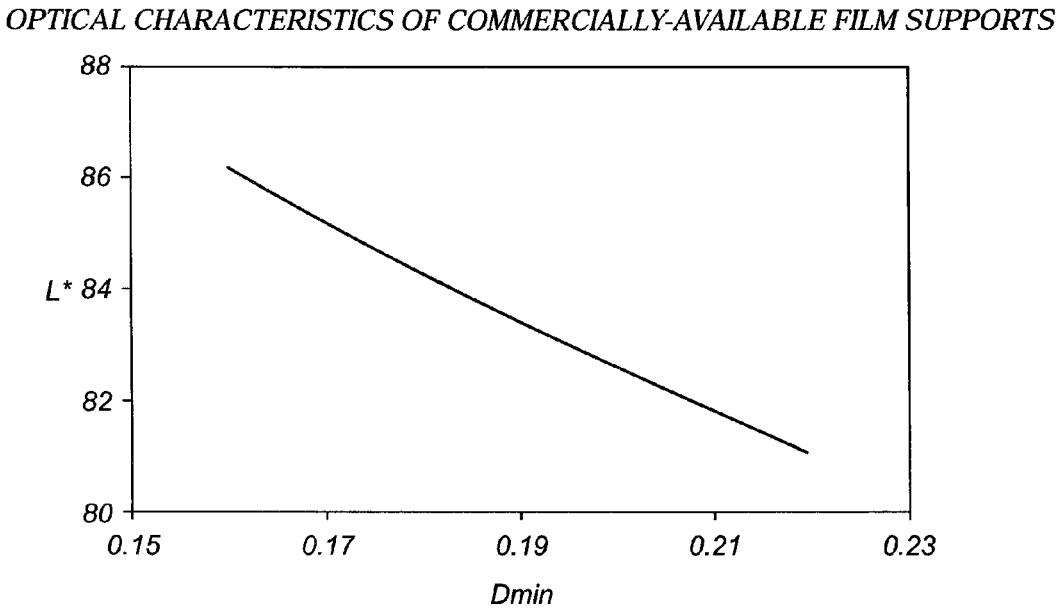
FIG. 3 shows optical characteristics of commercial films.
Figure 4:
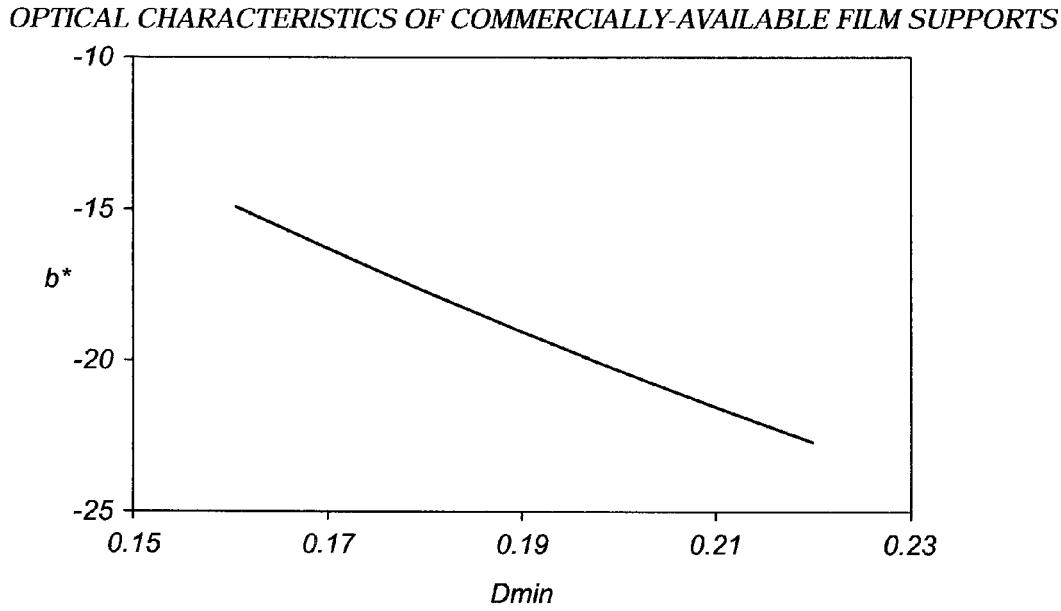
FIG. 4 shows optical characteristics of commercial films.

X-ray films have traditionally been coated on different dye-tinted film supports depending on the need for different image tone correction and/or concerns about film Dmin. As noted in the Background section, above, a portion of a film's Dmin is derived from the optical density of the film support. As can be seen, film-support Dmin has inverse relationships with both L* and b* as increased Dmin levels are correlated with lower L* or b* values. FIGS. 3 and 4 shows the relationships between L*, b* and Dmin for several commercially available X-ray film supports.

While the invention is being described with regard to radiography, those skilled in the art will recognize that the invention can be applied to other imaging applications, for example, business imaging such as document scanning.

EXAMPLES

Imaging and Evaluation of Samples in All Examples

Samples of the films were exposed through a graduated density step tablet to a MacBeth sensitometer for 0.5 second to a 500-watt General Electric DMX projector lamp that was calibrated to 2650° K filtered with a Corning C4010 filter to simulate a green-emitting X-ray screen exposure. The film samples were then processed using a processor commercially available under the trademark KODAK RP X-OMAT™ film Processor M6A-N, M6B, M35A, or X-OMAT 5000RA.

Development was carried out using the following black-and-white developing composition:

| Black-and-White Developing Composition | |
|---|---|
| Hydroquinone | 22 g/L |
| Phenidone | 1.3 g/L |
| pH | 10.3 |
| Temperature | 35° C. |

The film samples were processed for less than 90 seconds. Fixing was carried out using KODAK RP X-OMAT®LO Fixer and Replenisher fixing composition (Eastman Kodak Company). Optical densities are expressed below in terms of diffuse density as measured by a conventional X-rite Model 310TM densitometer that was calibrated to ANSI standard PH 2.19 and was traceable to a National Bureau of Standards calibration step tablet. The characteristic D vs. logE curve was plotted for each radiographic film that was imaged and processed. Speed was measured at a density of 1.0+Dmin. Gamma is the slope (derivative) of the noted curves.

Image quality was established using a detailed test object (DTO) and imaging such test object onto the film. A subjective measurement of image quality includes image sharpness, as measured on a scale of 1 to 10 (with 10 being the highest sharpness). Image sharpness is one part of image quality. Contrast and modulation-transfer function (MTF) both contribute to image sharpness.

Example 1

The diagram below is the layer structure of coating elements in Example 1. Each layer is detailed in subsequent diagrams. The coating elements of Example 1 are detailed further in TABLE I.

| Coating Diagram for Example 1 |
|---|
| Overcoat layer 1 |
| Interlayer 1 |
| Emulsion Layer 1 |
| polyethylene terephthalate support (containing 0.727 mg/dm$^2$ Blue Dye 1) |
| Emulsion layer 2 |
| Filter Dye layer |
| Interlayer 2 |
| Overcoat layer 2 |

| Overcoat layer 1 | |
|---|---|
| Material | mg PAI/dm$^2$ |
| Total gelatin coverage | 4.438 |
| Polymethyl-methacrylate matte beads | 0.4516 |
| Carboxymethylcasein | 0.9426 |
| Polyacrylamide | 0.6779 |
| Colloidal silica (Ludox AM) | 1.343 |
| Chrome alum | 0.03180 |
| 1,3-Benzenediol | 0.07312 |
| Sodium hydroxide | 0.02827 |
| Dow Corning lubricant DC-200 | 0.07988 |
| Methanesulfonic acid, trifluoro-, lithium salt | 0.4293 |
| Zonyl FSN | 0.1846 |

| Interlayer 1 | |
|---|---|
| Material | mg PAI/dm$^2$ |
| Total gelatin coverage | 4.438 |
| Carboxymethylcasein | 0.9426 |
| Polyacrylamide | 0.6768 |
| Chrome alum | 0.03180 |
| 1,3-Benzenediol | 0.07312 |
| Sulfuric acid | 0.1468 |
| (1,2,4)Triazolo(1,5-a)pyrimidin-7-ol, 5-methyl-, sodium salt | 0.5786 |
| Blue Dye 1 | TABLE I |
| AWNa polymer | 0.08064 |

| Emulsion Layer 1 | |
|---|---|
| Material | mg PAI/dm$^2$ |
| Total silver coverage as silver halide emulsion grains (TABLE I) | 31.75 |
| Total gelatin coverage | 26.91 |
| Ethene, 1,1'-(methylenebis(sulfonyl))bis- | 0.1431 |
| Potassium nitrate | 0.01435 |
| (1,2,4)Triazolo(1,5-a)pyrimidin-7-ol, 5-methyl-, sodium salt | 0.3043 |
| Polymer latex of butyl acrylate, styrene methacrylamide, and 2-acrylamido-2-methylpropane sulfonic acid, sodium salt | 1.817 |
| 3,6-Pyridazinedione, 1,2-dihydro- | 0.006667 |
| 1,3-Benzenedisulfonic acid, 4,5-dihydroxy-, disodium salt | 0.3861 |
| 1,2,3-Propanetriol | 0.1635 |
| Sodium hydroxide | 0.2357 |
| Potassium bromide | 0.1272 |
| 1,3-Benzenediol | 2.294 |

Support

The support is 0.170 μm thick polyethylene terephthalate containing 0.727 mg/dm$^2$ Blue Dye 1.

| Emulsion Layer 2 | |
|---|---|
| Material | mg PAI/dm$^2$ |
| Ethene, 1,1'-(methylenebis(sulfonyl))bis- | 0.6751 |
| Potassium nitrate | 0.07965 |
| Total gelatin coverage | 16.15 |
| Total silver coverage as silver halide emulsion grains (TABLE I) | 16.15 |
| 1,3-Benzenedisulfonic acid, 4,5-dihydroxy-, disodium salt | 0.1311 |
| 3,6-Pyridazinedione, 1,2-dihydro- | 0.006576 |
| D-Glucitol | 0.2585 |
| 1,2,3-Propanetriol | 0.3200 |
| 1,3-Benzenediol | 0.6537 |
| 1H-Indazole, 5-nitro- | 0.006324 |
| VERSA TL-502 (thickener) | 0.2320 |

Filter Dye Layer

The filter dye layer contains light absorbing filter dyes commonly employed in X-ray films. These are removed during processing. In this construction, this layer does not contain any blue-tinting dyes.

| Material | mg PAI/dm$^2$ |
|---|---|
| Total gelatin coverage | 8.073 |
| Sulfuric acid | 0.01171 |
| 1,4-Benzenedisulfonic acid, 2-(3-acetyl-4-(5-(3-acetyl-1-(2,5-disulfophenyl)-1,5-dihydro-5-oxo-4H-pyrazol-4-ylidene)-1,3-pentadienyl)-5-hydroxy-1H-pyrazol-1-yl)-, pentasodium salt | 0.1455 |
| 1H-Pyrazole-3-carboxylic acid, 1-(4-carboxyphenyl)-4-((4-(dimethylamino)phenyl)-methylene)-4,5-dihydro-5-oxo-, 3-ethyl ester | 2.153 |

| Interlayer 2 | |
|---|---|
| Material | mg PAI/dm$^2$ |
| Total gelatin coverage | 4.438 |
| Carboxymethylcasein | 0.9426 |
| Polyacrylamide | 0.6768 |
| Chrome alum | 0.03180 |
| 1,3-Benzenediol | 0.07312 |
| Sulfuric acid | 0.1513 |
| (1,2,4)Triazolo(1,5-a)pyrimidin-7-ol, 5-methyl-, sodium salt | 0.5786 |
| Oxiranemethanol, polymer with nonylphenol | 0.3634 |
| Blue Dye 1 | TABLE I |
| AWNa polymer | 0.1490 |

| Overcoat Layer 2 | |
|---|---|
| Material | mg PAI/dm$^2$ |
| Total gelatin coverage | 4.438 |
| Polystyrene matte beads | 0.1792 |
| Carboxymethylcasein | 0.9426 |
| Polyacrylamide | 0.6779 |
| Colloidal silica (Ludox AM) | 1.343 |
| Chrome alum | 0.03180 |
| 1,3-Benzenediol | 0.07312 |
| Sodium hydroxide | 0.02019 |
| Dow Corning lubricant DC-200 | 0.07988 |
| Methanesulfonic acid, trifluoro-, lithium salt | 0.4293 |
| Zonyl FSN | 0.1846 |

The term "Blue Dye 1 in Interlayers 1+2" refers to the total amount of Blue Dye 1 added to the film (mg/dm$^2$) in Interlayers 1 and 2 in Elements B, C, and D. For each Element, the Blue Dye 1 levels in Interlayers 1 and 2 are identical.

The term "Pct. Emulsion Layer 1 as prefog" refers to the percentage of silver halide in Emulsion Layer 1 that was prefogged in Controls E, F, and G by exposing the emulsion to light for 3 minutes prior to adding to the coating melt.

The term "b* at Dens. 1.2" refers to a CIELAB measurement of b* or image tone measured for the film exposed to a density of 1.2.

The term Dmin refers to the minimum density of a processed strip of film

The terms Speed and Contrast refer to measurements as described earlier in this document.

The term "Image Quality" refers to a subjective measurement of image sharpness as described earlier. TABLE I shows improved image quality with the addition of more dye even at higher Dmin.

The term "Predicted PET support with total Blue Dye 1 from Element" refers to a group of three columns which assist relating Example 1 to the invention specification The term "Total Blue Dye 1 (mg/dm$^2$)" refers to the total quantity of Blue Dye 1 in the Element.

Figure 5:
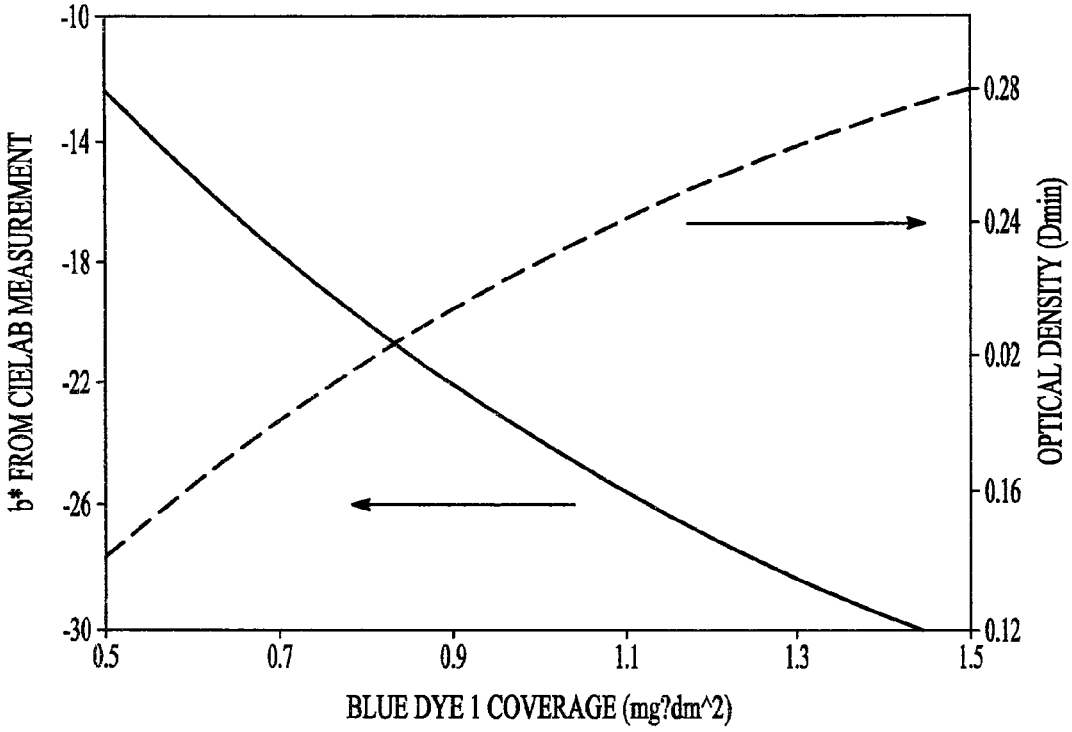
FIG. 5 shows optical characteristics and blue dye coverage for commercial films.

The terms b* and Dmin refer to predicted values for a PET support containing this level of Blue Dye 1 but no other layers. These values are based on the relationships between b*, Dmin, and Blue Dye 1 coated level shown in FIG. 5.

TABLE I below shows the results of film coatings for use in mammography. These films were coated on PET support containing 0.727 mg/dm$^2$ of Blue Dye 1 and having a L* value of 83.0 and a b* value of −18.6. Element A (Control) has a Dmin of 0.24 and reasonable image quality. Elements B, C (Controls) and D (Invention) have Dmin values at or exceeding the Dmin value of 0.25 which is the limiting value established by several standards committees for mammography. Despite these values for Dmin, image tone is improved (b* more negative) and image quality is improved (higher subjective ranking). Elements E-G (Controls) have Dmin values that exceed the standards limits but image tone and image quality are not improved. In fact, at the highest Dmin level (Element G), image tone and image quality is slightly degraded.

| Overcoat Layer 1 | |
|---|---|
| Material | mg PAI/dm$^2$ |
| Total gelatin coverage | 3.538 |
| Polymethyl-methacrylate matte beads | 0.2750 |
| Carboxymethylcasein | 0.7515 |
| Polyacrylamide | 0.5395 |
| Colloidal silica (Ludox AM) | 1.070 |
| Chrome alum | 0.02537 |
| 1,3-Benzenediol | 0.05847 |
| Sodium hydroxide | 0.02350 |
| Dow Corning lubricant DC-200 | 0.06368 |
| Methanesulfonic acid, trifluoro-, lithium salt | 0.3794 |
| Zonyl FSN | 0.1475 |

TABLE I

Comparison among Control Elements A-C, E-G and Inventive Element D, of Example 1

| Example 1 | | Blue Dye 1 in Interlayers 1 + 2 | % Emulsion Layer 1 as prefog | | Image Tone b* at Dens. | | | | Predicted PET support with total Blue Dye 1 from Element | | |
|---|---|---|---|---|---|---|---|---|---|---|---|
| Element | | (mg/dm$^2$) | (mg/dm$^2$) | Dmin | 1.2 | Speed | Contrast | Image Quality | Total Blue Dye 1 (mg/dm$^2$) | b* | Dmin |
| A | Control | 0 | | 0.24 | −8.7 | 420 | 4.3 | 5 | 0.727 | −18.6 | 0.19 |
| B | Control | 0.108 | | 0.25 | −9.5 | 419 | 4.3 | 6 | 0.834 | −20.9 | 0.21 |
| C | Control | 0.215 | | 0.27 | −10.9 | 418 | 4.3 | 8 | 0.942 | −22.9 | 0.22 |
| D | Inventive | 0.431 | | 0.31 | −13.1 | 415 | 4.3 | 9 | 1.157 | −26.3 | 0.25 |
| E | Control | | 1.7% | 0.27 | −8.8 | 419 | 4.3 | 5 | 0.727 | −18.6 | 0.19 |
| F | Control | | 3.4% | 0.31 | −8.6 | 419 | 4.3 | 5 | 0.727 | −18.6 | 0.19 |
| G | Control | | 6.8% | 0.38 | −8.5 | 420 | 4.3 | 4 | 0.727 | −18.6 | 0.19 |

Emulsion Layer 1 contains monodispersed cubic silver halide grains with mean ECD of 0.7 um and COV 7%

Emulsion Layer 2 contains polydispersed tabular grains with 2.5 um mean ECD and 0.088 um thickness, a COV of 24%, and an aspect ratio of 29.

Example 2

The diagram below represents the layer structure of coating elements in Example 2. Each layer is detailed in subsequent diagrams. The coating elements of Example 2 are detailed further in Table II.

| Coating Diagram for Example 2 |
|---|
| Overcoat layer 1 |
| Interlayer 1 |
| Emulsion Layer 1 |
| Polyethylene terephthalate support |
| (containing 0.727 mg/dm$^2$ Blue Dye 1) |
| Emulsion layer 2 |
| Interlayer 2 |
| Overcoat layer 2 |

| Interlayer 1 | |
|---|---|
| Material | mg PAI/dm$^2$ |
| Total gelatin coverage | 3.538 |
| Blue Dye 1 | TABLE II |
| 0.08 um silver iodide particles | 0.1076 |
| Carboxymethylcasein | 0.7529 |
| Polyacrylamide | 0.5395 |
| Colloidal silica (Ludox AM) | 1.070 |
| Chrome alum | 0.02537 |
| 1,3-Benzenediol | 0.05847 |
| Sodium hydroxide | 0.01153 |
| 1H-1,2,4-Triazolium, 1,4-diphenyl-3-(phenylamino)-, inner salt (nitron) | 0.03778 |
| (1,2,4)Triazolo(1,5-a)pyrimidin-7-ol, 5-methyl-, sodium salt | 0.4613 |

| Emulsion Layer 1 | |
|---|---|
| Material | mg PAI/dm$^2$ |
| Total gelatin coverage | 7.535 |

-continued

| Emulsion Layer 1 | |
|---|---|
| Material | mg PAI/dm$^2$ |
| Total silver coverage as silver halide emulsion grains (TABLE II) | 11.3 |
| Ethene, 1,1'-(methylenebis(sulfonyl))bis- | 0.07306 |
| Potassium nitrate | 0.07894 |
| 1,3-Benzenedisulfonic acid, 4,5-dihydroxy-, disodium salt | 0.09179 |
| 3,6-Pyridazinedione, 1,2-dihydro- | 0.004603 |
| D-Glucitol | 0.2819 |
| 1,2,3-Propanetriol | 0.3500 |
| Sodium hydroxide | 0.02076 |
| 1,3-Benzenediol | 0.4576 |
| Polyacrylamide | 2.153 |
| VERSA TL-502 (thickener) | 0.3014 |

Support

The support is 0.170 μm thick polyethylene terephthalate containing 0.727 mg/dm$^2$ Blue Dye 1.

| Emulsion Layer 2 | |
|---|---|
| Material | mg PAI/dm$^2$ |
| Total gelatin coverage | 7.535 |
| Total silver coverage as silver halide emulsion grains (TABLE II) | 11.3 |
| Ethene, 1,1'-(methylenebis(sulfonyl))bis- | 0.07306 |
| Potassium nitrate | 0.07894 |
| 1,3-Benzenedisulfonic acid, 4,5-dihydroxy-, disodium salt | 0.09179 |
| 3,6-Pyridazinedione, 1,2-dihydro- | 0.004603 |
| D-Glucitol | 0.2819 |
| 1,2,3-Propanetriol | 0.3500 |
| Sodium hydroxide | 0.02076 |
| 1,3-Benzenediol | 0.4576 |
| Polyacrylamide | 2.153 |
| VERSA TL-502 (thickener) | 0.3014 |

| Interlayer 2 | |
|---|---|
| Material | mg PAI/dm$^2$ |
| Total gelatin coverage | 3.538 |
| Blue Dye 1 | TABLE II |
| 0.08 um Silver iodide particles | 0.107643 |
| Carboxymethylcasein | 0.752851 |
| Polyacrylamide | 0.539545 |
| Colloidal silica (Ludox AM) | 1.069688 |
| Chrome alum | 0.025371 |
| 1,3-Benzenediol | 0.058468 |
| Sodium hydroxide | 0.009341 |
| 1H-1,2,4-Triazolium, 1,4-diphenyl-3-(phenylamino)-, inner salt (nitron) | 0.03778 |
| (1,2,4)Triazolo(1,5-a)pyrimidin-7-ol, 5-methyl-, sodium salt | 0.461269 |
| Oxiranemethanol, polymer with nonylphenol | 0.460205 |

| Overcoat Layer 2 | |
|---|---|
| Material | mg PAI/dm$^2$ |
| Total gelatin coverage | 3.538 |

-continued

| Overcoat Layer 2 | |
|---|---|
| Material | mg PAI/dm$^2$ |
| Gelatin | 1.626 |
| Polymethyl-methacrylate matte beads | 0.2750 |
| Carboxymethylcasein | 0.7515 |
| Polyacrylamide | 0.5395 |
| Colloidal silica (Ludox AM) | 1.070 |
| Chrome alum | 0.02537 |
| 1,3-Benzenediol | 0.05847 |
| Sodium hydroxide | 0.03362 |
| Dow Corning lubricant DC-200 | 0.06368 |
| Dow Coming SILICONE QCF2-5187 | 0.9155 |
| Oxiranemethanol, polymer with nonylphenol | 0.9153 |
| Methanesulfonic acid, trifluoro-, lithium salt | 0.3794 |

The term "Blue Dye 1 in Interlayers 1 & 2 (mg/dm$^2$)" is the total amount of Blue Dye 1 added to the film (mg/dm$^2$) in Interlayers 1 and 2 in Elements B, C, and D. For each Element, the Blue Dye 1 levels in Interlayers 1 and 2 are identical.

The term "Pct. Emulsion Layers 1 & 2 as prefog (mg/dm$^2$)" refers to the percentage of silver halide in Emulsion Layer 1 and 2 that was prefogged in Controls E-H by exposing the emulsion to light for 3 minutes prior to adding to the coating melt.

The term "b* at Dens. 1.2" refers to a CIELAB measurement of b* or image tone measured for the film exposed to a density of 1.2.

The term "Dmin" refers to the minimum density of an exposed strip of film.

The terms "Speed" and "Contrast" refer to measurements as described earlier in this document.

The term "Image Quality" refers to subjective measurement of image sharpness as described earlier.

The term "Predicted PET support with total Blue Dye 1 from Element" refers to a group of three columns which assist relating Example 2 to the invention specification The term "Total Blue Dye 1 (mg/dm$^2$)" refers to the total quantity of Blue Dye 1 in the Element.

The terms b* and Dmin refer to predicted values for a PET support containing this level of Blue Dye 1 but no other layers. These values are based on the relationships between b*, Dmin, and Blue Dye 1 coated level shown in FIG. 5.

TABLE II below shows the results of film coatings for use in general-purpose radiography. These films were coated on blue-tinted PET support containing 0.727 mg/dm$^2$ Blue Dye 1 and having a L* value of 83.0 and a b* value of −18.6. Element A (Control) has a Dmin of 0.24 and reasonable image quality. Elements B, C (Controls) and D (Invention) have Dmin values at or exceeding the Dmin value of 0.25 which is the limiting value established by several standards committees for general purpose radiography. Despite these values for Dmin, image tone is improved (b* more negative) and image quality is improved (higher subjective ranking). Elements E-H have Dmin values that exceed the standards limits but image tone and image quality are not improved. In fact, image tone and image quality is significantly degraded for all of the radiographic elements (E-H) with the highest Dmin levels.

TABLE II

Comparison among Control Elements A-C, E-H and Inventive Element D.

| Example 2 | | Blue Dye 1 in Interlayers 1 & 2 | % Emulsion Layers 1 & 2 as prefog | | Image Tone b* at Dens. | | | Image | Predicted PET support with total Blue Dye 1 from Element: Total Blue Dye 1 | | |
|---|---|---|---|---|---|---|---|---|---|---|---|
| Element | | (mg/dm$^2$) | (mg/dm$^2$) | Dmin | 1.2 | Speed | Contrast | Quality | (mg/dm$^2$) | b* | Dmin |
| A | Control | 0 | | 0.24 | −7.8 | 458 | 2.80 | 5 | 0.727 | −18.6 | 0.19 |
| B | Control | 0.108 | | 0.25 | −8.9 | 456 | 2.78 | 6 | 0.834 | −20.9 | 0.21 |
| C | Control | 0.215 | | 0.27 | −10.4 | 456 | 2.81 | 8 | 0.942 | −22.9 | 0.22 |
| D | Invention | 0.431 | | 0.31 | −12.9 | 455 | 2.78 | 10 | 1.157 | −26.3 | 0.25 |
| E | Control | | 1.9% | 0.38 | −7.8 | 456 | 2.69 | 4 | 0.727 | −18.6 | 0.19 |
| F | Control | | 4.8% | 0.52 | −7.7 | 453 | 2.42 | 3 | 0.727 | −18.6 | 0.19 |
| G | Control | | 9.5% | 0.76 | −7.6 | 449 | 2.10 | 2 | 0.727 | −18.6 | 0.19 |
| H | Control | | 14.3% | 0.97 | −7.2 | 444 | 1.46 | 1 | 0.727 | −18.6 | 0.19 |

Emulsion Layers 1 and 2 contain polydispersed tabular grains with 2.7 um mean ECD, a 0.076 um thickness, a COV of 20%, and an aspect ratio of 36.

The invention has been described in detail with particular reference to a presently preferred embodiments, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

What is claimed is:

1. A radiographic X-ray film comprising:

a polymer support;

having disposed on both sides thereof one or more silver halide emulsion layers that are the same or different wherein at least 50% of the total silver halide grain projected surface area comprises a tabular silver halide; and a blue anthraquinone dye contained within the polymer support, or within one or more additional hydrophilic layers or in both the polymer support and in the one or more additional hydrophilic layers;

and wherein the blue anthraquinone dye is present in a total amount of at least 1.1 mg/dm$^2$ and wherein the b* value is between −25 and −35.

2. The radiographic X-ray film of claim 1 wherein L* is between 70 and 80.

3. The radiographic X-ray film of claim 1 wherein the silver halide comprises silver bromoiodide.

4. The radiographic X-ray film of claim 1 wherein at least one of the silver halide layers further comprises one or more additional silver halide grain morphologies, one of which is monodisperse cubic silver halide grains.

5. The radiographic X-ray film of claim 1 wherein the silver halide is comprised of a halide composition having any combination of bromide, iodide, and chloride, subject to the sum total of halide moles equal to the moles of silver.

6. The radiographic X-ray film of claim 1 wherein the one or more additional hydrophilic layers is an interlayer and, wherein the blue dye is in the support or in the one or more interlayers or in both the support and one or more interlayers.

7. The radiographic X-ray film of claim 1 wherein the blue dye is in the polymer support.

8. The radiographic X-ray film of claim 1 wherein the blue anthraquinone dye comprises:

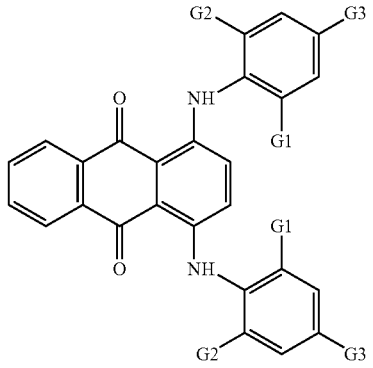

where each of G1, G2, and G3 is hydrogen or any alkyl group.

9. The radiographic X-ray film of claim 1 wherein the polymer support comprises a polyethylene terephthalate.

10. The radiographic X-ray film of claim 1 wherein the blue anthraquinone dye is one of:

Dye 1

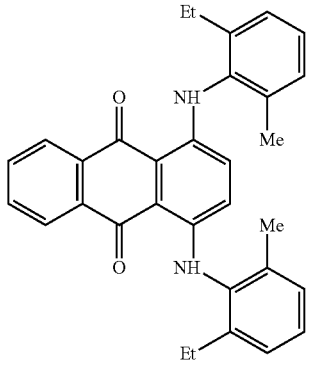

-continued

Dye 2

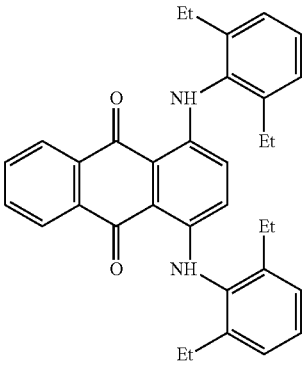

Dye 3

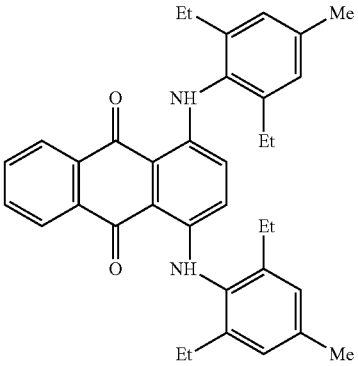

Dye 4

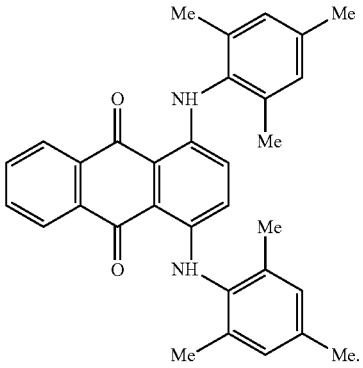

11. The radiographic X-ray film of claim 1 that is a mammography film.

12. The radiographic X-ray film of claim 1 that is a general purpose radiography film.

13. The radiographic X-ray film of claim 1 where the same silver halide emulsion is coated on both sides of the support, and comprises a tabular silver halide emulsion with an aspect ratio of greater than or equal to 5.

14. The radiographic X-ray film of claim 1 where different silver halide emulsions each comprising tabular grains, non-tabular grains, or mixtures thereof are coated on each side of the support, and wherein the tabular silver halide grains have an aspect ratio of greater than or equal to 5.

15. A radiographic X-ray film comprising:

a polymer support;

having disposed on both sides thereof one or more silver halide emulsion layers that are the same or different wherein at least 50% of the total silver halide grain projected surface area comprises a tabular silver halide;

wherein at least one of the silver halide layers further comprises one or more additional silver halide grain morphologies, one of which is monodisperse cubic silver halide grains; and a blue anthraquinone dye contained within the polymer support, or within one or more additional hydrophilic layers or in both the polymer support and in the one or more additional hydrophilic layers;

wherein the blue anthraquinone dye is present in a total amount of at least 1.1 mg/dm$^{2;}$ wherein the b* value is between −25 and −35;

wherein the blue anthraquinone dye comprises:

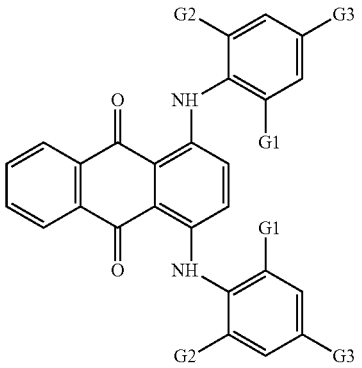

where each of G1, G2, and G3 is hydrogen or any alkyl group.

* * * * *